US006431433B2

(12) United States Patent
Kaden et al.

(10) Patent No.: US 6,431,433 B2
(45) **Date of Patent: *Aug. 13, 2002**

(54) CARDBOARD POCKET PACK WITH A CONCEALED TAMPERPROOF SEAL

(75) Inventors: Gert Kaden, Halstenbek; Günther Schultz, Hamburg, both of (DE)

(73) Assignee: Beiersdorf Aktiengesellschaft, Hamburg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/372,690

(22) Filed: Aug. 11, 1999

(30) Foreign Application Priority Data

Sep. 19, 1998 (DE) ..... 198 43 051

(51) Int. Cl.[7] ..... B65D 27/14

(52) U.S. Cl. ..... 229/80; 229/74; 229/80.5; 229/82

(58) Field of Search ..... 229/80, 82, 84, 229/80.5, 81, 307, 301, 313, 74, 68.2, 223, 224, 225, 228, 87.05; 206/461, 806; 383/9, 203

(56) References Cited

U.S. PATENT DOCUMENTS 873,416 A * 12/1907 Davis ..... 229/84
1,061,077 A * 5/1913 Hoffmann ..... 229/82
1,306,224 A * 6/1919 Godley ..... 229/313
1,382,426 A * 6/1921 Kleebauer ..... 229/74
2,363,957 A * 11/1944 Goff ..... 229/313
2,476,740 A * 7/1949 Krall ..... 229/80
2,833,461 A * 5/1958 Brom ..... 229/313
2,865,555 A * 12/1958 Stone ..... 229/81
3,124,299 A * 3/1964 Stone et al. ..... 229/81
3,313,473 A * 4/1967 Witters ..... 229/80
3,498,446 A * 3/1970 LaFreniere ..... 206/806 X
3,784,088 A * 1/1974 Shea et al. ..... 229/313
4,552,268 A * 11/1985 Lee ..... 229/225 X
4,727,988 A * 3/1988 Erickson ..... 229/84 X

* cited by examiner

*Primary Examiner*—Jes F. Pascua
(74) *Attorney, Agent, or Firm*—Norris McLaughlin & Marcus

(57) ABSTRACT

Cardboard pocket pack comprising a front wall and a rear wall which are connected to one another via a folding line and which are adhesively bonded as they lie one upon the other wherein a flap is articulated on the top edge of the front wall via a folding line, and the rear wall has a cutout into which the flap can be introduced, said rear wall having at least one spot of adhesive in an area of said rear wall that is located below the flap, whereby when the cardboard pocket pack has been assembled, the flap and the rear wall are adhesively bonded to one another.

17 Claims, 6 Drawing Sheets

CARDBOARD POCKET PACK WITH A CONCEALED TAMPERPROOF SEAL

BACKGROUND OF THE INVENTION

The invention relates to a recloseable cardboard pocket pack which is provided with a concealed tamperproof seal and can be filled mechanically.

A recloseable cardboard pocket pack which is made up of a front side and a rear side is known. Two flaps are articulated on the lateral edges of the front side, and said flaps are swung inwards through 180° and adhesively bonded to the rear side. Since the front side and the rear side are attached to one another via a folding line at their bottom edge in each case, the result is a cardboard pocket pack which is open towards the top and is suitable for receiving flat products, in particular plasters. In order to close the cardboard pocket pack, a further flap, which tapers trapezoidally upwards, is also articulated on the top edge. Finally, a section of essentially rectangular shape is provided centrally on the flap. Said section is inserted into a punched-out clearance, which is provided correspondingly in the rear wall, and thus form a closure which can be opened and closed repeatedly. However, the closure does not contain any tamperproof seal, with the result that the contents of the cardboard pocket pack can be tampered with without any visible signs being left as evidence of this.

Also known, from DE 296 06 678, is a swing-action blister card which can be opened repeatedly and of which the front and rear sides are attached to one another via a folding line. Furthermore, there is adhesively bonded on the front side a casing which serves for receiving a product, for example a lipcare stick.

The swing-action blister card is closed by virtue of a plurality of spots of adhesive having been applied to the front and rear walls, these spots of adhesive consisting of a pressure-sensitive adhesive.

SUMMARY OF THE INVENTION

The object of the invention is to provide a recloseable cardboard pocket pack which has a tamperproof seal, i.e. a closure which is irreversibly destroyed when opened for the first time and which nevertheless allows the cardboard pocket pack to be reclosed as desired.

This object is achieved by a cardboard pocket pack as is set down in the main claim. The subclaims relate to advantageous developments of the cardboard pocket pack in two embodiments. Finally, the idea of the invention also covers the punched blanks of the two embodiments, which form the basis for the production of the cardboard pocket pack.

DETAILED DESCRIPTION

Accordingly, the invention relates to a cardboard pocket pack comprising a front wall and a rear wall which are connected to one another via a folding line and which are adhesively bonded as they lie one upon the other, it being the case that a flap is articulated on the top edge of the front wall via a folding line. In the rear wall there is provided a cutout into which the flap can be introduced.

The cutout in the rear wall is preferably widened centrally in the form of a half-moon.

On that sub-region of the rear wall which is located beneath the flap there is then provided at least one spot of adhesive, with the result that, when the cardboard pocket pack has been assembled, the flap and the rear wall are adhesively bonded to one another.

In a preferred embodiment, the front wall and the rear wall are connected to one another via a folding line at the bottom edge in each case.

In each case one tab are [sic] advantageously articulated on the lateral edges of the front wall or of the rear wall via a folding line, and said tabs are swung inwards through 180° and used to bond the front wall and the rear wall adhesively.

In an alternative embodiment, the front wall and the rear wall are connected to one another via a folding line at a lateral edge in each case.

In a further preferred embodiment, a tab is articulated on that lateral edge of the front wall or of the rear wall which is located opposite the lateral edge at which the front wall and the rear wall are connected, and said tab is swung inwards through 180° and used to bond the front wall and the rear wall adhesively.

It has then been found to be advantageous if punched-out clearances are provided in the region of the bottom edge of the front wall and of the rear wall and are essentially congruent.

In a further preferred embodiment, the flap tapers trapezoidally from the folding line.

A grooved line is preferably provided in the flap and is aligned parallel to the predetermined tearing line [sic].

The surface area on the rear wall and/or the surface area on the lap beneath the spot or spots of adhesive have/has preferably been punched part of the way through. In an alternative embodiment, the surface area on the rear wall and/or the surface area on the flap beneath the spot or spots of adhesive have/has been punched right the way through, and are/is retained in the rear wall or flap by means of perforation lines.

Furthermore, the surface area on the rear wall beneath the spot or spots of adhesive may be separated off from the rest of the rear wall by means of a predetermined tearing line, the latter being designed, in particular, in the form of a half-moon.

The two advantageous features mentioned above may also be used in combination in the case of a cardboard pocket pack according to the invention.

By virtue of the flap and the rear wall being adhesively bonded to one another in the completed cardboard pocket pack, a tamperproof seal is achieved for the latter. On account of the spot or spots of adhesive, tearing open of the flap results in either the top surface of the rear side of the flap or the top surface of the front side of the rear wall (the cover layer of the cardboard in each case) being destroyed.

Straightforward reclosure can be carried out by the flap, said closure being achieved by the punched-out clearance on the rear-side surface of the cardboard pocket pack.

However, when the cardboard pocket pack has been reclosed, it is clear for all to see that the pack has already been opened for the first time, with the result that it is not possible to remove products which are provided within the cardboard pocket pack without the tamperproof closure being destroyed.

As a result of the surface area on the rear wall and/or the surface area on the flap beneath the spot or spots of adhesive being advantageously punched part of the way through, it is only the surface area which has been punched part of the way through which comes away when the tamperproof seal is torn open. This only insignificantly detracts from the appearance of the cardboard pocket pack.

In the alternative embodiment, the surface area on the rear wall and/or the surface area on the flap beneath the spot or spots of adhesive have/has been punched right the way through, and are/is retained in the rear wall or flap by means of perforation lines. When the cardboard pocket pack is opened, the surface area is thus torn out of the surface area surrounding it and remains on the respective adhesive surface area. This makes it very clear that the cardboard pocket pack has already been torn open for the first time.

Should the surface area on the rear wall beneath the spot or spots of adhesive be separated off from the rest of the rear wall by means of a predetermined tearing line, the predetermined tearing line is torn open when the tamperproof seal is opened for the first time, with the result that said surface area remains on the inside of the flap. This also makes it immediately clear that the cardboard pocket pack has already been opened for the first time.

Finally, the idea of the invention also covers two punched blanks, by means of which two particularly advantageous embodiments of the cardboard pocket pack according to the invention can be produced.

Thus, the first punched blank contains a cardboard pocket pack which comprises a front wall and a rear wall which are connected to one another via a folding line at the bottom edge in each case, it being the case that i) in each case one tab is articulated on the lateral edges of the front wall via a folding line, ii) a flap is articulated on the top edge via a folding line, iii) a punched-out clearance is provided, if appropriate, in the region of the bottom edge, it being the case that iv) in the rear wall there is provided a cutout into which the flap can be introduced and which is widened, if appropriate, centrally in the form of a half-moon, and it being the case that v) on that sub-region of the rear wall which is located beneath the flap there is provided at least one spot of adhesive, with the result that, when the cardboard pocket pack has been assembled, the flap and the rear wall are adhesively bonded to one another.

The second punched blank relates to a cardboard pocket pack which comprises a front wall and a rear wall which are connected to one another via a folding line at a lateral edge in each case, it being the case that i) a tab is articulated on the other lateral edge of the front wall via a folding line, ii) a flap is articulated on the top edge via a folding line, iii) a punched-out clearance is provided, if appropriate, in the region of the bottom edge, it being the case that iv) in the rear wall there is provided a cutout into which the flap can be introduced and which is widened, if appropriate, centrally in the form of a half-moon, and it being the case that v) on that sub-region of the rear wall which is located beneath the flap there is provided at least one spot of adhesive, with the result that, when the cardboard pocket pack has been assembled, the flap and the rear wall are adhesively bonded to one another.

The cardboard pocket pack according to the invention is suitable, in particular, for very small quantities of products, for example one to four plasters. The products can be introduced into the cardboard pocket pack mechanically. Said cardboard pocket pack is then closed by mechanical adhesive bonding.

Advantageous embodiments of the cardboard pocket pack according to the invention will be illustrated in more detail hereinbelow with reference to a number of figures, without the invention being unnecessarily limited thereby.

BRIEF DESCRIPTION OF THE DRAWINGS

In the figures:

FIG. 1 shows the punched blank 1 of a cardboard pocket pack which is formed by a rectangular front wall 11 and an essentially rectangular rear wall 21, the front wall 11 and rear wall 21 being connected to one another via a folding line 111 at the bottom edge in each case.

Figure 1:
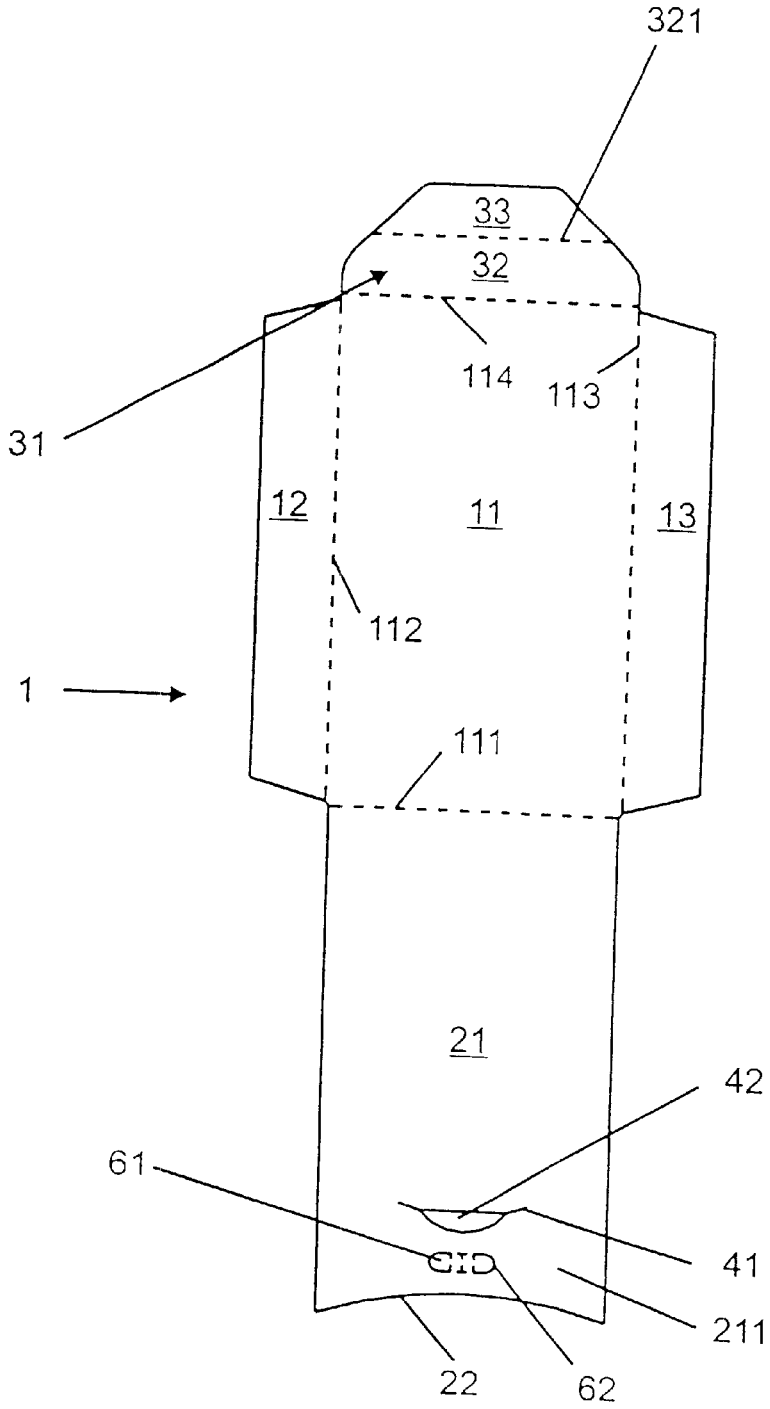
FIG. 1 shows the punched blank of a cardboard pocket pack in which the front wall and the rear wall are connected to one another at the bottom edge in each case, and in which the rear wall has a surface area which has been punched part of the way through, FIG. 2 shows the punched blank of a cardboard pocket pack in which the front wall and the rear wall are connected to one another at the bottom edge in each case, and in which the rear wall has a surface area which is separated off by means of a predetermined tearing line.

In each case one tab 12, 13 is articulated on the lateral edges of the front side 11 via a folding line 112, 113. The tabs 12, 13 extend over the entire length of the front wall 11 and taper slightly trapezoidally outwards.

For the purpose of assembling the cardboard pocket pack, the tabs 12, 13 are swung inwards through 180° and provided with an application of adhesive. The rear wall 21 is pressed onto this application of adhesive, this resulting in a cardboard pocket pack which is closed on three sides.

A flap 31 is articulated on the top edge of the front wall 11 via a folding line 114. The flap 31, which is made up of two portions 32, 33, which for their part are separated by a grooved line 321, the grooved line 321 being aligned parallel to the folding line 114, tapers trapezoidally outwards.

The grooved line 321 weakens the cardboard in the region of the flap 31, this ruling out tearing of the cardboard when the flap 31 is introduced into the cutout 41.

The top edge 22 of the rear wall 21 is drawn inwards in the form of an arc, in order to facilitate access to the contents in the completed cardboard pocket pack.

Furthermore, this prevents the occurrence of excessive restoring forces in the region of the flap 31 when the latter is inserted into the cutout 41.

The cutout 41 is provided in the region of the top edge 22 and has a half-moon-shaped widening 42 in the centre.

The cutout 41 is angled slightly towards the border, which makes it easier to close the cardboard pocket pack for the first time in the [sic] the flap 31 is inserted into the cutout 41.

When the cardboard pocket pack is closed for the first time following the filling operation, a spot of adhesive 61 is positioned on the sub-region 211 of the rear wall 21, said sub-region being located beneath the flap 31, more precisely beneath the portion 32 of the flap 31, with the result that, when the cardboard pocket pack has been assembled, the portion 32 of the flap 31 and the rear wall 21 are adhesively bonded to one another.

Furthermore, the surface area 62 on the rear wall 21 beneath the spot of adhesive 61 has been punched part of the way through. The cardboard pocket pack can only be opened if the flap 31 adhesively bonded to the rear wall 21 is pulled off, with the result that the top surface of the surface area 62, the cover layer of the cardboard, remains on the flap 31.

It is thus immediately clear for all to see that the cardboard pocket pack has already been opened for the first time.

Figure 2:
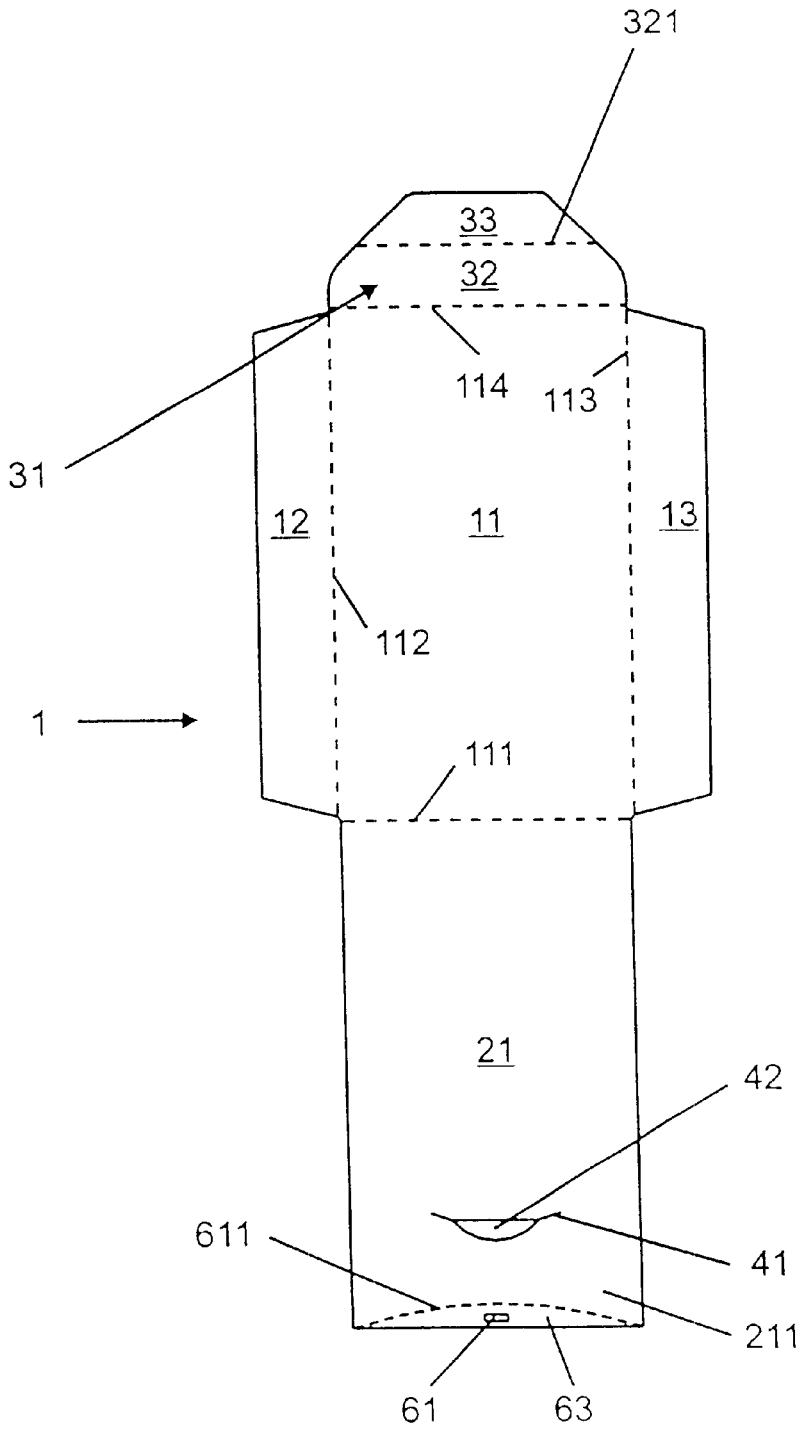

FIG. 2 shows an alternative embodiment of the cardboard pocket pack according to FIG. 1.

One or more spots of adhesive 61 are positioned on the sub-region 211 of the rear wall 21, said sub-region being located beneath the flap 31, with the result that, when the cardboard pocket pack has been assembled, the portion 32 of the flap 31 and the rear wall 21 are adhesively bonded to one another.

The spot of adhesive 61 or adhesive region is located on a surface area 63 which is separated off from the rest of the rear wall 21 by means of a half-moon-shaped predetermined tearing line 611. The half-moon-shaped predetermined tearing line 611 likewise facilitates access to the contents in the completed cardboard pocket pack, and the occurrence of excessive restoring forces in the region of the flap 31 when the latter is inserted into the cutout 41 is also prevented in this case.

When the cardboard pocket pack is opened for the first time, the predetermined tearing line 611 is torn open, with the result that said surface area 63 remains on the inside of the portion 32 of the flap 31. This also makes it immediately clear that the cardboard pocket pack has already been opened for the first time.

The rear wall 21 does not have a surface area which has been punched part of the way through beneath the spot of adhesive, as is shown in FIG. 1.

Figure 3:
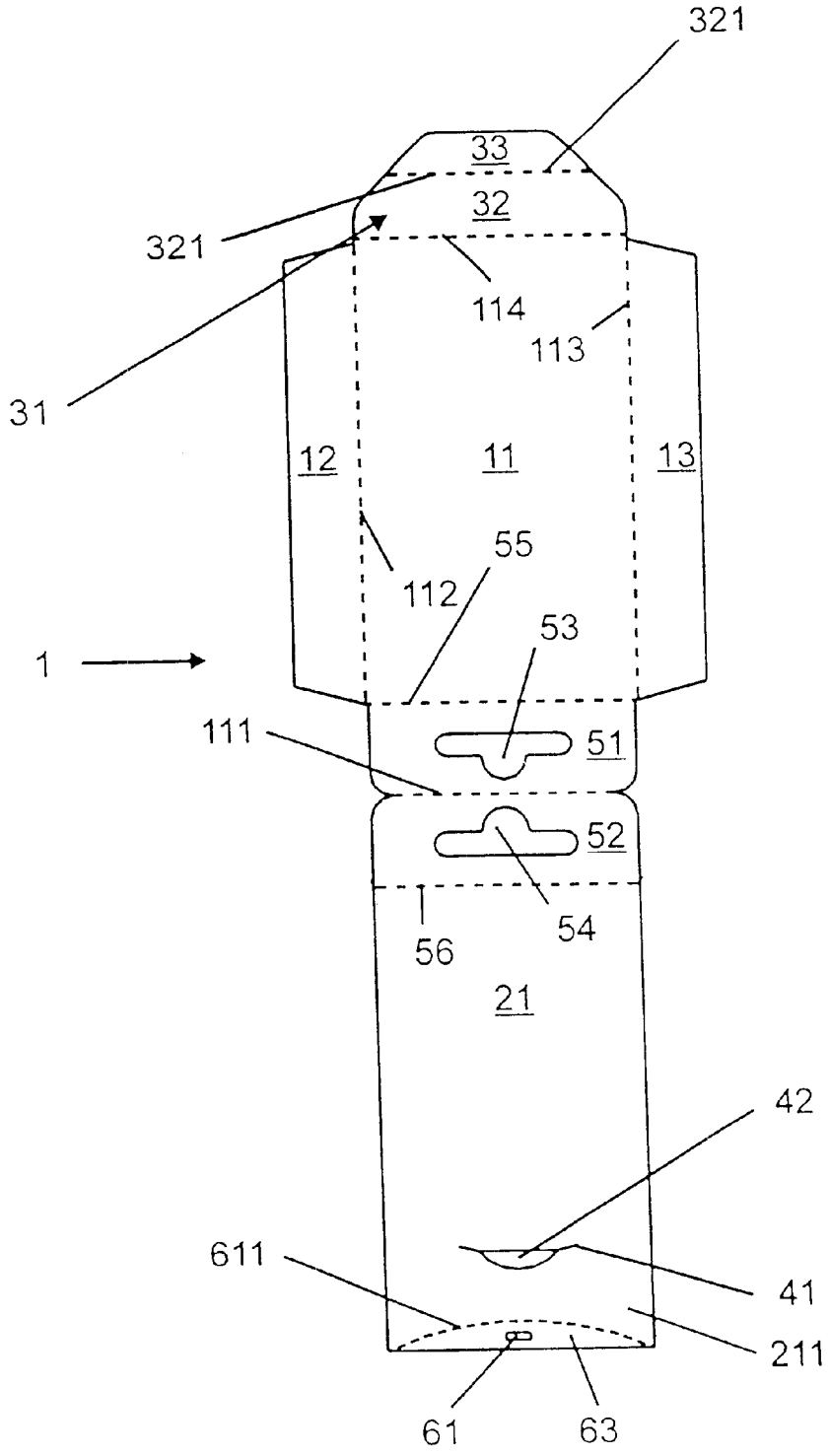
FIG. 3 shows the punched blank of a cardboard pocket pack according to FIG. 2, punched-out clearances being additionally provided in the front wall and the rear wall.

The punched blank 1 for a cardboard pocket pack according to FIG. 2 is illustrated in FIG. 3. In the front wall 11 and in the rear wall 21, two regions 51, 52 are separated off by perforation lines 55, 56 merely in the region of the bottom edges, said regions having punched-out clearances 53, 54, to be precise in the form of slots and/or round holes, in the centre. The punched-out clearances 53, 54 are largely congruent.

The tabs 12, 13, which are articulated on the front wall 11, have a length which has been reduced by the width of the section 51.

Furthermore, the sections 51, 52 are separated off from the rest of the front wall 11 and rear wall 21, respective:y, via perforation lines 55, 56.

In the completed cardboard pocket pack, the regions 51, 52 are adhesively bonded to one another and thus form a hanging lug, with the aid of which the cardboard pocket pack may advantageously be displayed in the known sales racks.

Figure 4:
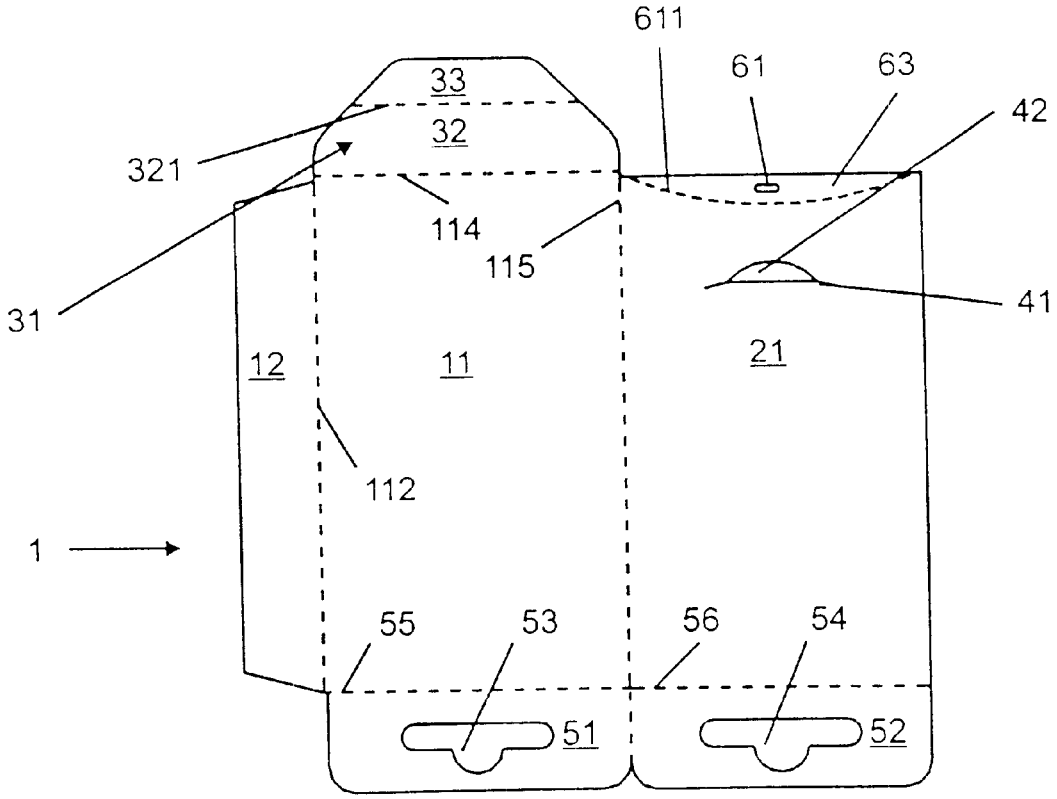
FIG. 4 shows the punched blank of a cardboard pocket pack in which the front wall and the rear wall are connected to one another at a lateral edge in each case.

FIG. 4 shows a second embodiment of a punched blank 1 for a cardboard pocket pack. In this case, the front wall 11 and the rear wall 21 are connected to one another via a folding line 115 at a lateral edge in each case. In contrast, a single tab 12 is articulated on the opposite lateral edge of the front wall 11.

For the purpose of assembling the cardboard pocket pack, said tab 12 is swung inwards through 180° and provided with an application of adhesive, onto which the rear wall 21 is pressed.

The other features of the punched blanks 1 correspond to that [sic] which have already been explained in relation of FIG. 2 and FIG. 3.

The manner of attaching the front wall 11 and rear wall 21 means that the rear wall 21 is aligned in a state in which it has merely been rotated through 180° in relation to the rear wall 21 from FIG. 3; otherwise the two rear walls are identical.

Figure 5:
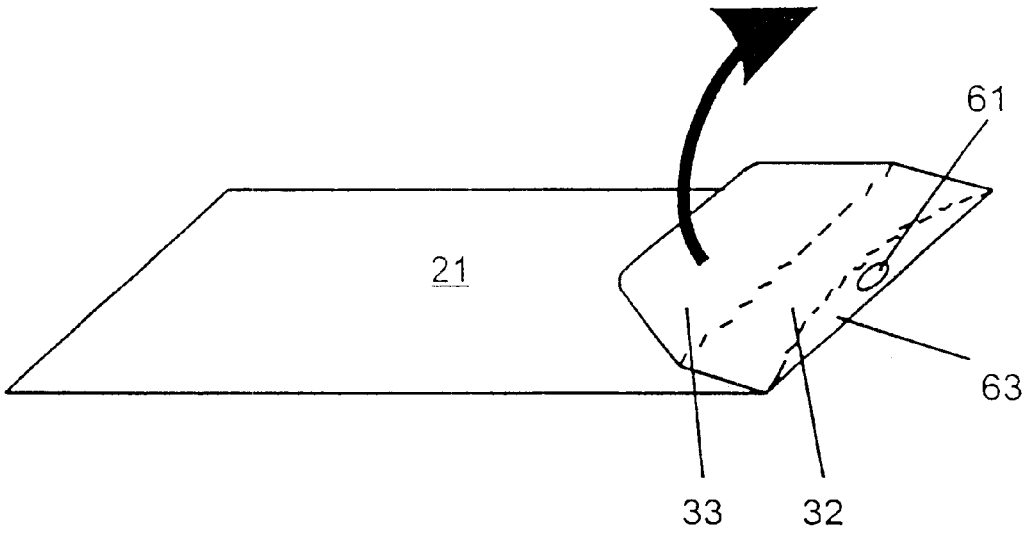
FIG. 5 shows the opening operation for a cardboard pocket pack according to FIG. 2.
Figure 6:
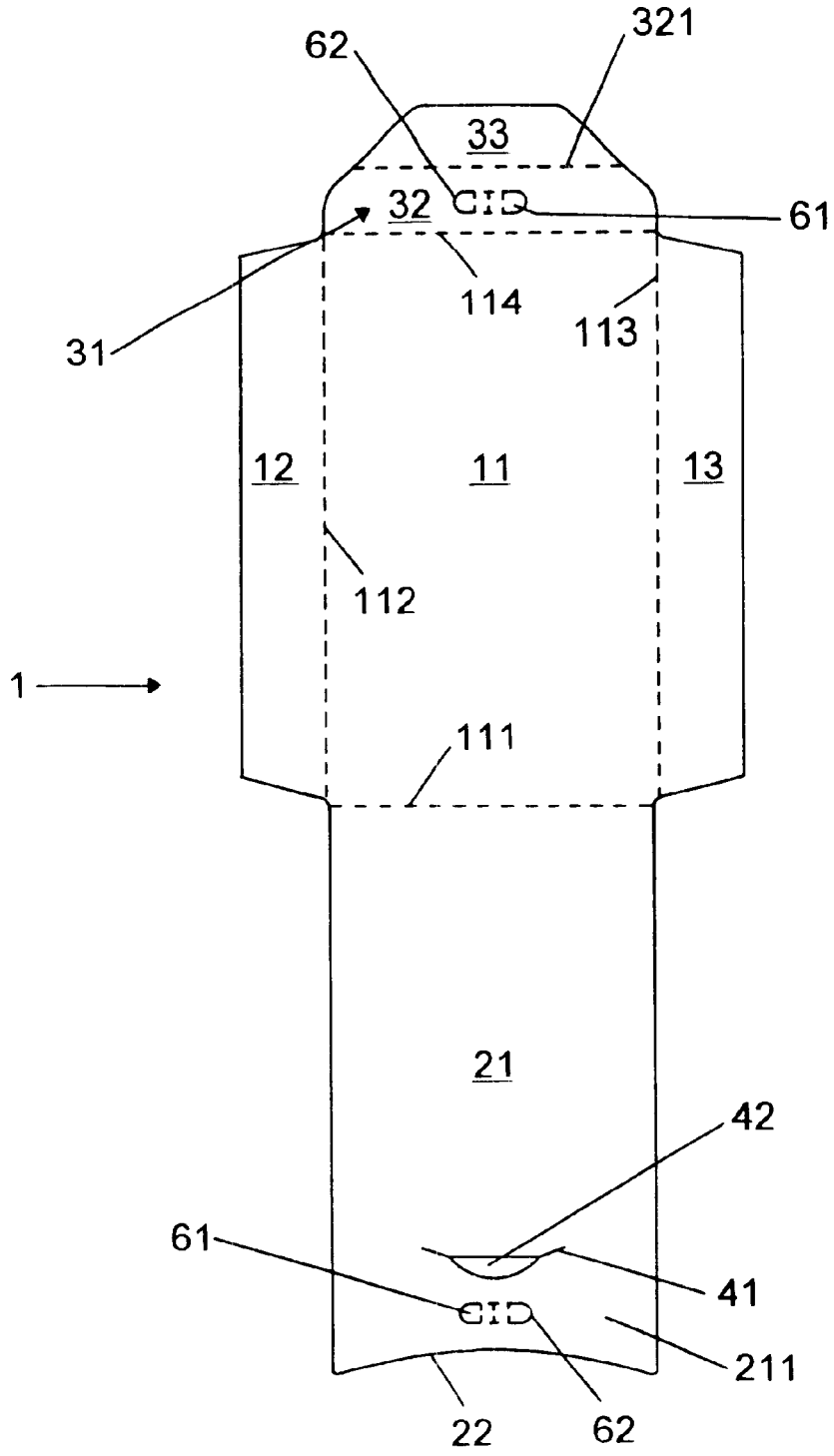

FIG. 5 illustrates the operation of opening the cardboard pocket pack according to-the invention from FIG. 2. The second portion 33 of the flap 31 serves as a grip in order for the half-moon-shaped surface area 63 to be separated from the rear wall 21, said surface area then remaining on the first portion 32.

The opening takes place by pulling the second portion 33 in the direction of the arrow.

We claim:

1. A reclosable cardboard pocket pack comprising a front wall and a rear wall, each of said walls having a top edge, a bottom edge, and two side edges, said walls substantially overlaying and being connected to each other by a folding line adjoining either said bottom edges or a side edge of each, and said walls being adhesively bonded one on top of the other, the top edge of said front wall having a flap articulated thereon via a folding line, said rear wall having a cutout adapted to receive insertion of said flap, said flap being adhesively bound to said rear wall by at least one spot of adhesive to seal said pocket pack, said rear wall, said flap, or both, having a surface area in contact with said at least one spot of adhesive which is perforated at least part way through said rear wall, said flap, or both, so that when said rear wall and said flap are separated said perforated surface area or areas in contact with said at least one spot of adhesive will be torn, without destruction of the flap itself, providing evidence that said pocket pack has been opened, while still retaining the structural integrity of the flap and cutout so that the pocket pack can be resealed, and said pocket pack being reclosable, after a first opening, by insertion of said flap into said cutout in said rear wall.

2. The cardboard pocket pack according to claim 1, wherein said walls are connected to each other by a folding line adjoining their bottom edges.

3. The cardboard pocket pack according to claim 1, further comprising first and second tabs articulated only on the side edges of the front wall or of the rear wall by folding lines, and wherein said first and second tabs are swung inwards through 180° and used to bond the front wall and the rear wall adhesively.

4. The cardboard pocket pack according to claim 1, wherein the front wall and the rear wall are connected to each other by a folding line adjoining a side edge of each.

5. The cardboard pocket pack according to claim 4 further comprising a tab articulated only on that side edge of the front wall or of the rear wall which is located opposite the side edge at which the front wall and rear wall are connected, and wherein said tab is swung inwards through 180° and used to bond the front wall and the rear wall adhesively.

6. The cardboard pocket pack according to claim 1, wherein the flap is substantially trapezoidal in shape and the base of the flap is defined by said folding line at said top edge of said front wall.

7. The cardboard pocket pack according to claim 1, wherein a grooved line is provided on the flap and is aligned parallel to the folding line at said top edge of said front wall.

8. The cardboard pocket pack according to claim 1, wherein the surface area of the rear wall beneath the at least one spot of adhesive, the surface area of the flap beneath the at least one spot of adhesive, or both, are punched part or all of the way through and retained in place by perforation lines.

9. The cardboard pocket pack according to claim 1, wherein the surface area of the rear wall beneath said at least one spot of adhesive is separated off from the rest of the rear wall by a predetermined tearing line, which is designed in the form of a half-moon.

10. The cardboard pocket pack according to claim 1, wherein the cutout in the rear wall is widened centrally in the form of a half-moon.

11. The reclosable cardboard pocket pack of claim 1, wherein said rear wall has a predetermined tearing line beneath that part of said rear wall that is bound to said flap by said at least one spot of adhesive, whereby, when said tearing line is torn away and the packet pack opened, that part of said rear wall that is bound to said flap by said at least one spot of adhesive will remain attached to said flap, providing evidence that said pocket part has been opened, while still retaining the structural integrity of the flap and cutout so that the pocket pack can be resealed.

12. Punched blank for a cardboard pocket pack which comprises a front wall and a rear wall, each of said walls having a top edge, a bottom edge, and two side edges; said walls being connected to each other by a folding line adjoining said bottom edges, said front wall having a tab articulated on each side edge by a folding line and a flap articulated on the top edge via a folding line, and a punched-out clearance is provided in the region of the bottom edges of both walls, said rear wall having a cutout adapted to receive insertion of said flap, at least one spot of adhesive being placed on an area of said rear wall which, when said front wall and rear wall are folded along said folding line adjoining their side edges, will cause said at .least spot of adhesive to contact said flap and adhere said flap to said rear wall so that, when the cardboard pack has been assembled, the flap and the rear wall are adhesively bonded to each other.

13. The punched blank of claim 12 further comprising first and second tabs articulated only on the side edges of the front wall or of the rear wall by folding lines, and wherein said first and second tabs are swung inwards through 180° and used to bond the front wall and the rear wall adhesively.

14. Punched blank for a cardboard pocket pack which comprises a front wall and a rear wall, each of said walls having a top edge, a bottom edge, and two side edges; said walls being connected to each other by a folding line adjoining one side edge of each, said front wall having a tab articulated on the side edge that is not adjoined to said rear wall, by a folding line and a flap articulated on the top edge via a folding line, and a punched-out clearance is provided in the region of the bottom edges of both walls, said rear wall having a cutout adapted to receive insertion of said flap, and at least one spot of adhesive being. placed on an area of said rear wall which, when said front wall and rear wall are folded along said folding line adjoining their side edges, will cause said at least one spot of adhesive to contact said flap and adhere said flap to said rear wall so that, when the cardboard pack has been assembled, the flap and the rear wall are adhesively bonded to each other.

15. The punched blank of claim 14, further comprising a tab articulated only on that side edge of the front wall or of the rear wall which is located opposite the side edge at which the front wall and rear wall are connected, and wherein said tab is swung inwards through 180° and used to bond the front wall and the rear wall adhesively.

16. A reclosable cardboard pocket pack comprising:

a front wall and a rear wall, each of said walls having a top edge, a bottom edge, and two side edges, said walls substantially overlaying and being connected to each other by a folding line adjoining either said bottom edges or a side edge of each, and said walls being adhesively bonded one on top of the other, the top edge of said front wall having a flap articulated thereon via a folding line, said rear wall having a cutout adapted to receive insertion of said flap, said flap being adhesively bound to said rear wall by at least one spot of adhesive to seal said pocket pack;

wherein said rear wall, said flap, or both, have a surface area in contact with said at least one spot of adhesive and which is perforated at least part way through said rear wall, said flap, or both, so that when said rear wall and said flap are separated, said perforated surface area in contact with said at least one spot of adhesive will be torn, without destruction of the flap itself, providing evidence that said pocket pack has been opened, while still retaining the structural integrity of the flap and cutout so that the pocket pack can be resealed;

wherein said pocket pack is reclosable, after a first opening, by insertion of said flap into said cutout in said rear wall; and wherein punched-out clearances are provided in the regions of the respective bottom edges of the front wall and the rear wall and are essentially congruent.

17. The cardboard pocket pack of claim 16, wherein said rear wall has a predetermined tearing line beneath that part of said rear wall that is bound to said flap by said at least one spot of adhesive, whereby, when said tearing line is torn away and the packet pack is opened, that part of said rear wall that is bound to said flap by said at least one spot of adhesive will remain attached to said flap, providing evidence that said pocket part has been opened, while still retaining the structural integrity of the flap and cutout so that the pocket pack can be resealed.

* * * * *